US007360759B2

(12) United States Patent
Ramseier et al.

(10) Patent No.: US 7,360,759 B2
(45) Date of Patent: Apr. 22, 2008

(54) APPARATUS FOR TRANSFERRING PRODUCTS TO A CONVEYING ARRANGEMENT

(75) Inventors: Marcel Ramseier, Wetzikon (CH); Beat Studer, Durnten (CH)

(73) Assignee: Ferag AG, Hinwil (CH)

( * ) Notice: Subject to any disclaimer, the term of this patent is extended or adjusted under 35 U.S.C. 154(b) by 614 days.

(21) Appl. No.: 10/672,113

(22) Filed: Sep. 26, 2003

(65) Prior Publication Data

US 2004/0061276 A1 Apr. 1, 2004

(30) Foreign Application Priority Data

Sep. 30, 2002 (CH) ..... 1634/02

(51) Int. Cl.
*B65H 29/04* (2006.01)

(52) U.S. Cl. ..... 271/3.24; 271/268

(58) Field of Classification Search ..... 271/204, 271/3.24, 272–274, 277, 82, 85; 294/104, 294/106

See application file for complete search history.

(56) References Cited

U.S. PATENT DOCUMENTS 2,280,799 A 4/1942 Davidson
4,034,845 A * 7/1977 Honegger ..... 198/418
4,320,894 A 3/1982 Reist et al.
4,424,965 A 1/1984 Faltin
4,466,320 A 8/1984 Tokuno et al.
4,550,822 A 11/1985 Meier
4,674,739 A 6/1987 Smith
5,819,663 A 10/1998 Klaas et al.
6,019,047 A 2/2000 Klaas et al.
6,457,708 B2 * 10/2002 Honegger ..... 271/204
6,488,278 B1 * 12/2002 Hansch ..... 271/268

* cited by examiner

*Primary Examiner*—Patrick Mackey
*Assistant Examiner*—Jeremy R Severson
(74) *Attorney, Agent, or Firm*—Brinks Hofer Gilson & Lione

(57) ABSTRACT

The invention relates to an apparatus by means of which sheet like products which follow one after the other along a feed section are transferred to a conveying arrangement with individually controllable grippers which can be moved in the conveying direction, are arranged one behind the other and are designed for gripping the products at their leading edge, the feed section having, in its end region which is directed toward the conveying arrangement, a conveying nip, in which the sheet-like products are retained, at least in part, on both sides, in the case of which apparatus, in the product-receiving region of the grippers, a positive stop, which is active during each product transfer, is provided for the leading edges of the products, the spacing between the positive stop and conveying nip being selected such that the trailing edges of the products are still located in the conveying nip when the leading edges strike against the positive stop.

16 Claims, 4 Drawing Sheets

APPARATUS FOR TRANSFERRING PRODUCTS TO A CONVEYING ARRANGEMENT

FIELD OF THE INVENTION

The invention relates to an apparatus by means of which sheet-like products, which follow one after the other along a feed section, are transferred to a conveying arrangement with individually controllable grippers which can be moved in the conveying direction and are designed for gripping the products at their leading edge, wherein the feed section has, in an end region which is directed toward the conveying arrangement, a conveying nip in which the sheet-like products are retained, at least in part, on both sides.

BACKGROUND OF THE INVENTION

By means of such apparatuses, for example, printed products which are transported in an imbricated formation on a conveying belt are transferred to a further conveying arrangement, which is capable of gripping individual printed products with a respective gripper, as a result of which the printed products retained in the grippers can be fed separately for further processing. Such an apparatus is known from U.S. Pat. No. 4,320,894. In the case of the apparatus disclosed therein, printed products are fed, via a conveying belt, to a conveying nip which serves for deflecting the printed products. Once the printed products have left the conveying nip, they pass into a transfer region, in which they are gripped individually at their leading edge by controllable grippers. Provided in the transfer region is a stop rail for printed products which pass too early into the transfer region, said stop rail preventing these printed products from moving further, in order to ensure that printed products which have entered too early can easily be gripped at the correct point in time by the gripper assigned to them. Also provided in the transfer region is a deflecting arrangement, which raises the printed products slightly in the region of their leading edge in order thus to allow the printed product to be easily gripped by the gripper assigned to it. The deflecting arrangement here also has, inter alia, stops which are designed as spring plates, are intended for printed products which are delayed in entering and result in these delayed printed products, in the first instance, being deflected downward, in order to avoid damage to the printed products. These printed products are then raised again by the deflecting arrangement at the point in time at which they can be gripped by the gripper provided for them. Both the abovementioned stop bar and the stops designed as spring plates have no function if a printed product which is to be transferred—and this is the normal case—enters into the transfer region at the envisaged point in time.

The above-described apparatus according to the prior art, on the one hand, has the disadvantage that the printed products, at the moment they are gripped by the grippers assigned to them, merely rest on a conveying arrangement, but are not fixed there in any way, with the result that it is not ensured that the printed products can be gripped in a precise position in each case by the grippers. On the other hand, the above-described apparatus also has the disadvantage that, for printed products of different sizes, types and/or thicknesses, it has to be adjusted in each case in adaptation to the respective printed products.

SUMMARY OF THE INVENTION

It is an object of the invention to provide an apparatus of the type mentioned in the introduction which, in addition to products being received in a precise position by the grippers of the conveying arrangement, also makes it possible for products of different sizes, thicknesses and types to be processed without significant adjustment to the apparatus being necessary for each product changeover.

This object is achieved according to the invention in that, in the product receiving region of the grippers, a positive stop, which is active during each product transfer, is provided for the leading edges of the products, the spacing between the positive stop and conveying nip being selected such that the trailing edges of the products are still located in the conveying nip when the leading edges strike against the positive stop.

According to the invention, the positive stop, which is active during each product transfer, thus achieves the situation where the relative position between the product and gripper, from transfer to transfer, always remains constant since the positive stop always positions the products in the same way within the open gripper. Furthermore, the spacing selected according to the invention between the positive stop and conveying nip ensures that the products are always retained in a defined and active manner throughout the product receiving process, to be precise, as long as the gripper is open, by the conveying nip and then, for a short period of time, by the conveying nip and the closed gripper and, after leaving the conveying nip, exclusively by the gripper. The products are thus at no time during the product receiving process, as in the prior art, only resting on a conveying means, with the result that, in contrast to the prior art, the invention ensures that no displacement or slipping of the products can take place. The always identical and correct position which is thus achieved for the products in all the grippers allows precise further processing of the products.

Since the apparatus according to the invention may be designed such that the spacing between the positive stop and conveying nip is adapted to the shortest possible product length, it is also easily possible in this case for the apparatus according to the invention to be used for any desired longer product lengths without adjustment work being necessary for this purpose. Furthermore, the opening extent of the grippers may be set to receive comparatively thick products. In this case, it is also then, in turn, possible for thinner products to be gripped by means of the grippers without any adjustment work.

It is advantageous if at least part of the positive stop is of moveable design, in particular such that it can be moved synchronously with a gripper taking part in the product receiving process. This makes it possible to achieve the situation where either the entire positive stop or, in the case of only part of the positive stop moving, the region of the latter which is active for the products can run along with the respective gripper throughout the product receiving process, with the result that the positive stop is always active and/or the product is always positioned in a defined manner within the open gripper.

The positive stop may be of two part design, it being possible for the first part of the positive stop to be of stationary configuration and for the second part to be of moveable configuration. In this case, the two parts of the positive stop may form two stop surfaces which run at an angle to one another, the product always butting against that region of the positive stop at which the two surfaces intersect. If, then, one surface is of stationary design and the second surface is designed such that it can be moved synchronously with the gripper, the point of intersection of the two surfaces, and thus the active region of the positive stop, moves along with the gripper, this inevitably resulting in the already mentioned correct positioning in the open gripper throughout the product receiving process.

The moveable part of the positive stop may be formed by an element of a gripper taking part in the product transfer process, for example by a leading leg of this gripper or a guide surface connected to said leg. This coupling of the moveable part of the positive stop to the gripper advantageously results in there being no need to provide, between the positive stop and gripper, any high outlay apparatuses which synchronize the movement of the positive stop and gripper with one another. Rather, the direct coupling of the moveable part of the positive stop to the gripper automatically results in the abovementioned synchronization.

If the moveable part of the positive stop is formed by a guide surface connected to the leading leg of the gripper, it is advantageous if this guide surface, in the closed state of the gripper, is oriented at least essentially parallel to the product abutment surface of the trailing gripper leg. This results in the products being reliably retained from both sides by means of surface contact.

The gripper legs of the grippers can preferably be pivoted individually and/or together about a pivot pin moving in the conveying direction, said gripper legs being coupled, in particular, to an endlessly circulating transporting chain or to individual carriages which run in a guide, and can likewise circulate endlessly. The fact that the gripper legs can pivot individually and independently of one another makes it possible for opening and closing movements of the grippers to be controlled on a very individual basis, in order thus to allow products to be received and discharged in optimum fashion by the grippers. The fact that the, in particular, closed gripper legs can pivot together makes it possible, for example, for products retained in the grippers always to be oriented essentially vertically downward, to be precise irrespective of the slope of the conveying direction in each case.

In order to allow for the gripper legs to be pivoted individually, each gripper leg, in the region of the conveying arrangement, may be assigned a dedicated control guide which controls the opening and closing movement of the respective gripper legs.

The feed section, which is arranged upstream of the conveying arrangement, may be designed as a conveying belt, a pressure-exerting belt which can be driven at the speed of the conveying belt and runs, at least in part, parallel to the conveying belt being provided in that end region of the conveying belt which is directed toward the conveying arrangement. The conveying nip according to the invention is then formed between the pressure exerting belt and conveying belt. The pressure exerting belt may be driven either actively by means of a drive roller or passively by means of operative connection to the conveying belt.

The feed section, which is arranged upstream of the conveying arrangement, or the conveying nip, in its respective end region which is directed toward the conveying arrangement, may run in a plane which is inclined in relation to the horizontal. The conveying nip in particular runs in an essentially vertical plane, with the result that the products conveyed through the conveying nip leave the latter in the upward direction and, accordingly, can be gripped from above by means of a gripper.

The invention also comprises a method of operating an apparatus of the above-described type, in the case of which:

the sheet-like products, in that end region of the feed section which is directed toward the conveying arrangement, are transported through a conveying nip until they butt, by way of their leading edges, against the positive stop provided in the product receiving region of the grippers, the conveying movement through the conveying nip is continued and a closing movement of the grippers is initiated, and the grippers are closed completely while the trailing edges of the products are still located in the conveying nip.

The advantages which have already been explained in the introduction are likewise achieved by this method.

The conveying movement through the conveying nip during the closing movement of the grippers each receiving a product can take place continuously. This allows straightforward activation of the feed section without a change in speed.

The speed of the products in the conveying nip and the transporting speed of the grippers during the product-transfer process may be at least essentially equal. It is likewise possible, however, to select the speed of the products in the conveying nip to be slightly greater than the transporting speed of the grippers during the product-transfer process. The last mentioned case results in the products being conveyed actively against the positive stop throughout the transfer process since they move more quickly than said positive stop.

The speed of the products in the conveying nip and the transporting speed of the grippers during the product-transfer process may be at least essentially constant, which, in turn, simplifies the activation of the feed section and of the conveying arrangement.

It is preferred if the speed of the products in the conveying nip and the transporting speed of the grippers during the product-transfer process are co-ordinated with one another such that the products butting against the positive stop are buckled, or pass into a curved-out state, before the grippers are closed completely. In this way, the products butt reliably, with a certain amount of prestressing, against the positive stop, albeit without any possibility of them being inflected. In this case, it is particularly preferred if the speed of the products in the conveying nip and the transporting speed of the grippers during the product-transfer process are co-ordinated with one another such that the products which are [lacuna] by closed grippers in their front region and have their rear region still located in the conveying nip are straightened out again without the products being subjected to destructive tensile loading.

As an alternative, or in addition, the above-described operations of buckling and straightening out the products during the transfer process may also be achieved by a corresponding orientation of the conveying nip and of the transporting direction of the grippers. For example, it is possible, in this context, for the conveying nip to be oriented essentially vertically, with the result that the products leave it in the upward direction, while the grippers, during the product-transfer process, move, in the first instance, essentially perpendicularly to the conveying nip and then increasingly in the direction of the conveying nip. Such a movement path of the grippers can be realized, for example, by a deflecting wheel, along the circumference of which the grippers move during the transfer process.

The closing movement of the grippers is preferably at least essentially completed while the leading edges of the products butt against the positive stop. It is thus ensured that the products are positioned precisely in the gripper until the latter closes.

If the leading gripper legs are provided with a guide surface of the type already described, it is advantageous if this guide surface, at least over a time interval immediately preceding completion of the closing movement of the gripper legs, is oriented at least essentially parallel to the respectively trailing gripper leg. It is thus possible for products with vastly varying thicknesses to be gripped over the surface area uniformly well, reliably and from both sides without the gripper being changed in any way.

Within the context of the invention, the products may be fed to the conveying arrangement, via the feed section, in a regular or irregular imbricated information or also at intervals from one another. Any relatively small irregularities which may be present are automatically compensated for in that the products, during the transfer process through the conveying nip, are conveyed actively against the positive stop.

BRIEF DESCRIPTION OF THE DRAWINGS

The invention is described hereinbelow, by way of exemplary embodiments, with reference to the drawings, in which.

DESCRIPTION OF THE PREFERRED EMBODIMENTS

Figure 1:
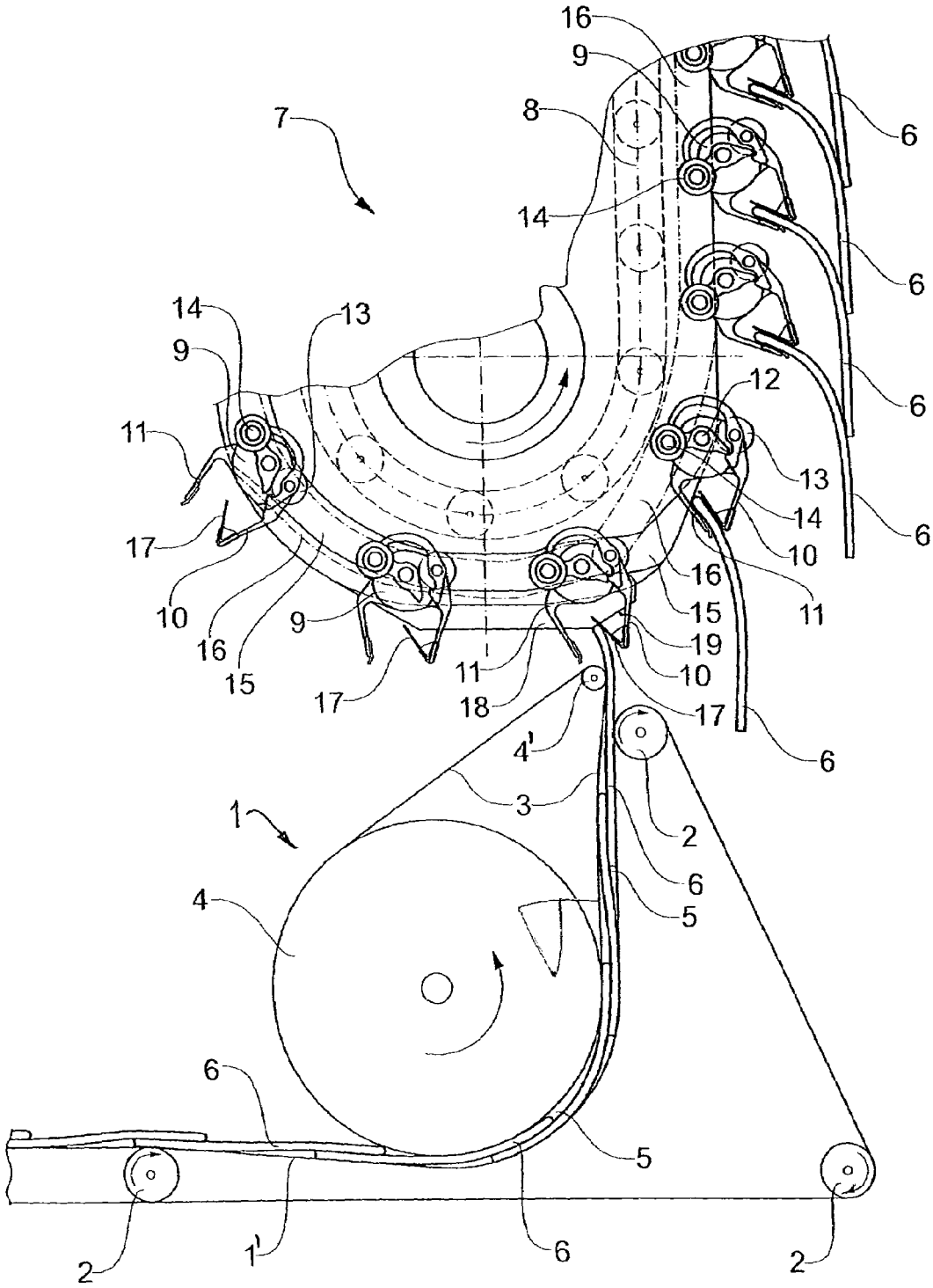
FIG. 1 shows a schematic side view of an apparatus according to the invention with a feed section and a conveying arrangement having a plurality of circulating grippers.

FIG. 1 shows, in its bottom region, a feed section 1 which is designed as an endlessly circulating conveying belt 1', although only an end region of the latter with a total of three deflecting and guide rollers 2 is illustrated in FIG. 1. The conveying belt 1' runs, in the first instance, in an essentially horizontal direction, whereupon it describes an upwardly oriented quarter-circle path and then runs vertically upward over a short region. In the top end region, the conveying belt 1' is deflected over a deflecting roller 2.

A pressure exerting belt 3, which circulates endlessly over two rollers 4, 4', is provided in the region of the abovementioned quarter-circle path and in the region of the vertical extent of the conveying belt 1'.

The roller 4 of the pressure-exerting belt 3 rotates in the counterclockwise direction. The grippers 9 move over a semicircular path, in the counterclockwise direction, in the bottom, U-shaped portion of the conveying arrangement 7.

Via the conveying belt 1', starting from, for example, a winding station or a feed station, products 6 formed, for example, as printed products are transported in the horizontal direction to the region of the conveying nip 5, where they then pass between the conveying belt 1' and the pressure exerting belt 3 into the conveying nip 5. In the conveying nip 5, the products 6 are retained under prestressing between the conveying belt 1' and pressure-exerting belt 3 over the entire length of the conveying nip 5 and are thus conveyed in a defined manner through the conveying nip 5. At the end of the conveying nip 5, the products 6 have only one side butting against the pressure-exerting belt 3, whereas the conveying-belt-side surface of the products 6, on account of the conveying belt 1' already terminating further down, are exposed, with the result that, at the end of the conveying nip 5, it is basically possible for the products 6 to be deflected away from the pressure-exerting belt 3 onto the side of the conveying belt 1'.

In the top end region of the conveying nip 5, the products 6 accordingly leave the conveying nip in a vertically upwardly extending direction. They thus pass into the region of a conveying arrangement 7, which comprises a circulating transporting chain 8, which is illustrated in part in FIG. 1 and has grippers 9, which are arranged one behind the other, fastened on it. In its bottom end region, which is directed toward the feed section 1, the transporting chain 8 describes an essentially U-shaped path, with the result that the grippers 9 move essentially over a semicircular path above the conveying nip 5. This semicircular path is arranged relative to the conveying nip 5 such that the horizontal movement component of the grippers 9 directly above the conveying nip 5 is larger than the vertical movement component thereof, the horizontal movement component decreasing more and more, as the movement of the grippers 9 continues, until the grippers 9, ultimately, move only vertically upward.

Each gripper 9 comprises a leading leg 10 and a trailing leg 11, the two of which can be pivoted independently of one another about a common pivot pin 12.

The leading gripper legs 10 are each assigned to a first control roller 13 and the trailing gripper legs 11 are each assigned to a second control roller 14. A possible construction of the activating mechanism for the grippers 9 can be gathered from the applicant's U.S. Pat. No. 5,395,151.

The first control rollers 13 run in a first control guide 15, which is assigned to said control rollers 13, whereas the control rollers 14 run in a further, second control guide 16, which is assigned to said second control rollers 14. Each control guide 15, 16 thus controls the movement of the leading and trailing legs 10, 11 of the grippers 9 individually and independently of one another.

At their end which is directed away from the transporting chain 8, the leading legs 10 of the grippers 9 are connected to a guide surface 17 such that the leading legs 10, together with the guide surfaces 17 in each case are in the form of a V which is open in the direction of the transporting chain 8. Accordingly, the spacing between the guide surface 17 and leading leg 10, starting from that end of the leading leg 10 which is directed away from the transporting chain 8, increases in the direction of the transporting chain 8.

The V-shape described is selected here such that the guide surface 17, in the closed state of the grippers 9, is oriented at least essentially parallel to the product abutment surface of the trailing leg 11.

In the bottom end of the conveying arrangement 7, this end being directed toward the feed section 1, a stationary part 18 of a positive stop is arranged in the product-transfer region. This stationary part 18 extends essentially horizontally above the roller 4, in order then to run obliquely upward approximately above the conveying nip 5. The resulting oblique surface 19, in its projection which can be seen from FIG. 1, intersects the guide surface 17 of a gripper 9 receiving a product 6, with the result that the abovementioned oblique surface of the stationary part 18 together with the respective guide surface 17 of the grippers 9 form an essentially V-shaped stop, which is open at the bottom, for the leading edges of the products 6.

Figure 2:
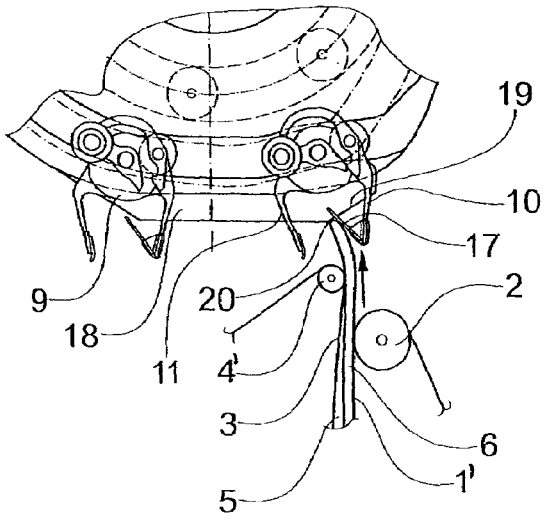
FIGS. 2 to 5 show a view, in detail form, of the product transfer region between the feed section and conveying arrangement according to FIG. 1 in four method stages which follow one after the other in time.

The procedure for transferring products from the feed section to the conveying arrangement is explained hereinbelow with reference to FIGS. 2 to 5:

According to FIG. 2, the leading edge 20 of a product 6 passes through the conveying nip 5, in the arrow direction, into the opening region of a gripper 9, in specific terms between the guide surface 17, which is coupled to the leading leg 10, and the trailing leg 11 of the gripper 9. As a result of the product 6 being conveyed continuously through the conveying nip 5, the leading edge 20 of the product 6 ultimately strikes against the stationary part 18, in particular against the oblique surface 19 thereof, the precise position of the leading edge 20 being defined by the stationary part 18 interacting with the moving guide surface 17. The leading edge 20 of the product 6 is thus always located in the region of the point/line of intersection between the guide surface 17 and oblique surface 19, which can be seen from FIG. 2.

As the gripper 9 continues moving along its transporting path, the above-described point/line of intersection moves along with the gripper 9, as a result of which the active region of the positive stop formed from the guide surface 17 and oblique surface 19 moves away upward to the right from the end of the conveying nip 5, together with the gripper 9.

Since the pressure-exerting belt 3 extends further upward than the conveying belt 1, it is ensured that the product 6 butting against the positive stop 17, 19 can only curve out in one direction away from the pressure-exerting belt 3. Such outward curvature 21 can be seen from FIG. 3, according to which the gripper 9 has moved in its transporting direction to such an extent, in relation to FIG. 2, that that end of the guide surface 17 which is directed away from the leading leg 10 of the gripper 9 ends up located in the region of the end of the oblique surface 19. In this position, the leading edge 20 of the product 6 continues to be retained in a defined manner by the positive stop 17, 19, although in this case the position of this positive stop 17, 19 has been displaced upward to the right along the oblique surface 19 in relation to FIG. 2.

Figure 3:
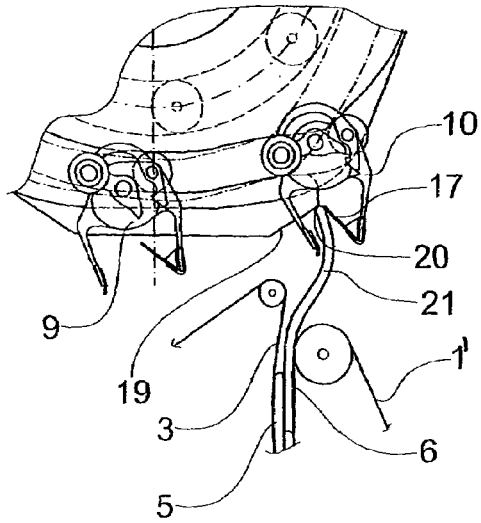

The abovementioned outward curvature 21 of the product 6 is produced by the product 6 being conveyed continuously through the conveying nip 5 and on account of the fact that the gripper 9, between the positions according to FIGS. 2 and 3, moves predominantly perpendicularly, rather than parallel, to the conveying nip 5. This outward curvature 21 results in the product 6 butting, to a certain extent under prestressing, against the positive stop 17, 19 by way of its leading edge 20. Since the conveying belt 1 terminates at a lower level than the pressure-exerting belt 3, it is ensured here that the product 6 is merely curved out and not inflected.

Figure 4:
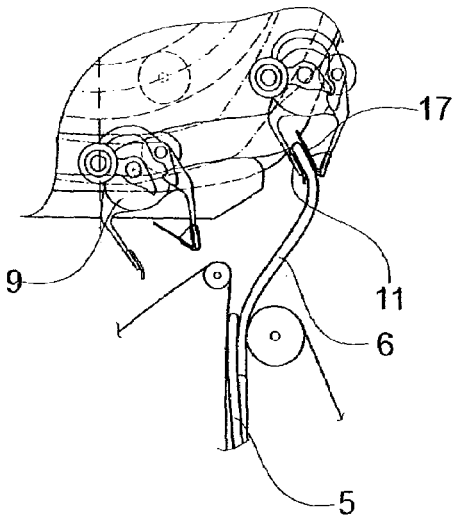

Immediately following the position illustrated in FIG. 3, the gripper 9 is closed completely, with the result that the product 6 ends up located with its front region between the guide surface 17 and the trailing leg 11 of the gripper 9, as is illustrated in FIG. 4. It can be gathered from FIG. 4 that, in the closed state of the gripper 9, the guide surface 17 and the product-abutment surface of the trailing leg 11 are oriented parallel to one another, this resulting in full-surface-area abutment of these elements against both sides of the product 6.

On account of the U-shaped movement path of the grippers 9 in the product-transfer region, the horizontal movement component of the grippers 9, this component running perpendicularly to the conveying nip 5, decreases following closure of the respective gripper 9, while the vertical movement component, running parallel to the conveying nip 5, of the gripper increases. Since the product 6, as it is retained in its front region by the gripper 9, still has its rear region fixed in the conveying nip 5, the curving out of the product 6 according to FIG. 3 is followed by a straightening-out movement of the product 6. In this case, the conveying speeds of the conveying nip 5 and of the grippers 9 are co-ordinated with one another such that damage to the products 6 is reliably avoided.

Figure 5:
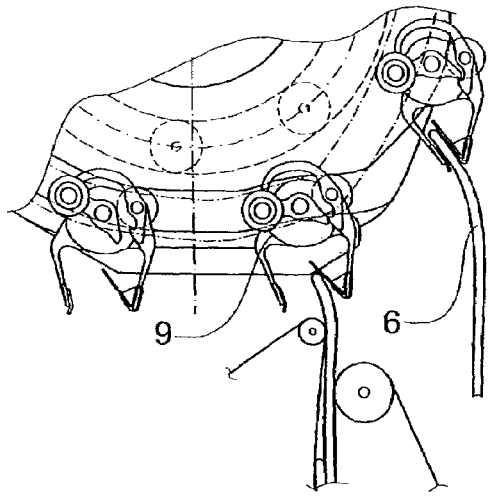

Following the above-described straightening-out operation, the product 6 is then moved out of the conveying nip 5 altogether according to FIG. 5, with the result that its rear region hangs freely downward under the action of gravitational force, while the front product region is retained in a defined manner by the gripper 9.

The procedure of products being transferred from a feed section 1 to a conveying arrangement 7 as has been described by FIGS. 2 to 5 makes clear the fact that the positive stop 17, 19 ensures that each product 6 gripped by a gripper 9 always extends to a precisely equal depth into the gripper region formed between the guide surface 17 and trailing leg 11, to be precise irrespective of the thickness and/or size of the product in each case. This allows precise further processing of the products since the relative position between the gripper and product cannot be changed.

Furthermore, the V-shape of the positive stop 17, 19, which is open downward in the direction of the conveying nip 5, results in the products 6, irrespective of their thickness, always passing correctly into the active region of this positive stop 17, 19 and being orientated with their front region essentially perpendicularly to the oblique surface 19.

As can be gathered from looking at FIGS. 3 and 4 together, the guide surface 17 and the trailing leg 11 of the gripper 9 form, during the closing operation, a more or less parallel guide nip for the relevant product 6, this guide nip running more or less at right angles to the oblique surface 19.

Figure 6:
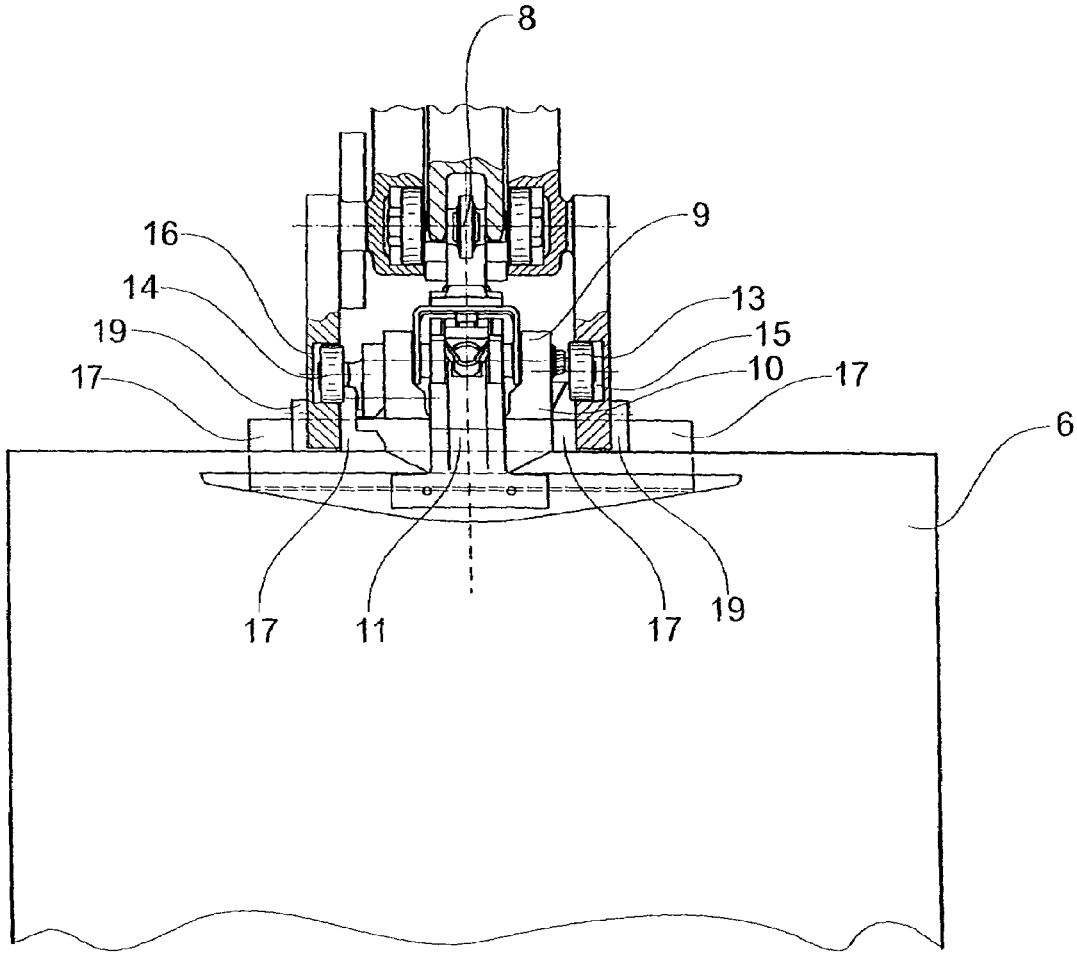
FIG. 6 shows a view, partly in section, of a gripper used according to the invention, the gripper retaining a product.

FIG. 6 shows a gripper which may be used for an apparatus according to FIGS. 1 to 5.

According to FIG. 6, a product 6 is retained by a gripper 9, of which the leading leg 10, which has a shallow V-shape in its bottom end region, is shown in FIG. 6. The leg 10 is connected to a control roller 13, which runs in a control guide 15.

FIG. 6 also shows the control roller 14 for the trailing leg 11, this control roller running in the control guide 16. The gripper 9, with its two legs 10, 11, is retained overall on a transporting chain 8, which will not be explained in any more detail here.

Provided on the leading leg 10 of the gripper 9 is an essentially rectangular guide surface 17, for example made of spring sheet steel, which extends transversely beyond the leg 10 on both sides and forms a product-abutment surface of the leading leg 10.

Finally, FIG. 6 also illustrates the two-part oblique surface 19 of the stationary part of the positive stop 17, 19 according to the invention. This two-part oblique surface 19 extends in each case beneath the control guides 15, 16, to be precise in a manner in which it is offset slightly outward in relation to the latter. The spacing between these stationary, guide like parts 18 with the oblique surfaces 19 ensures that the products 6 are gripped by the grippers 9 not just to the same depth on the inside but also in a precisely defined rotary position—i.e., preferably with the leading edge running at right angles to the conveying direction.

Figure 7:
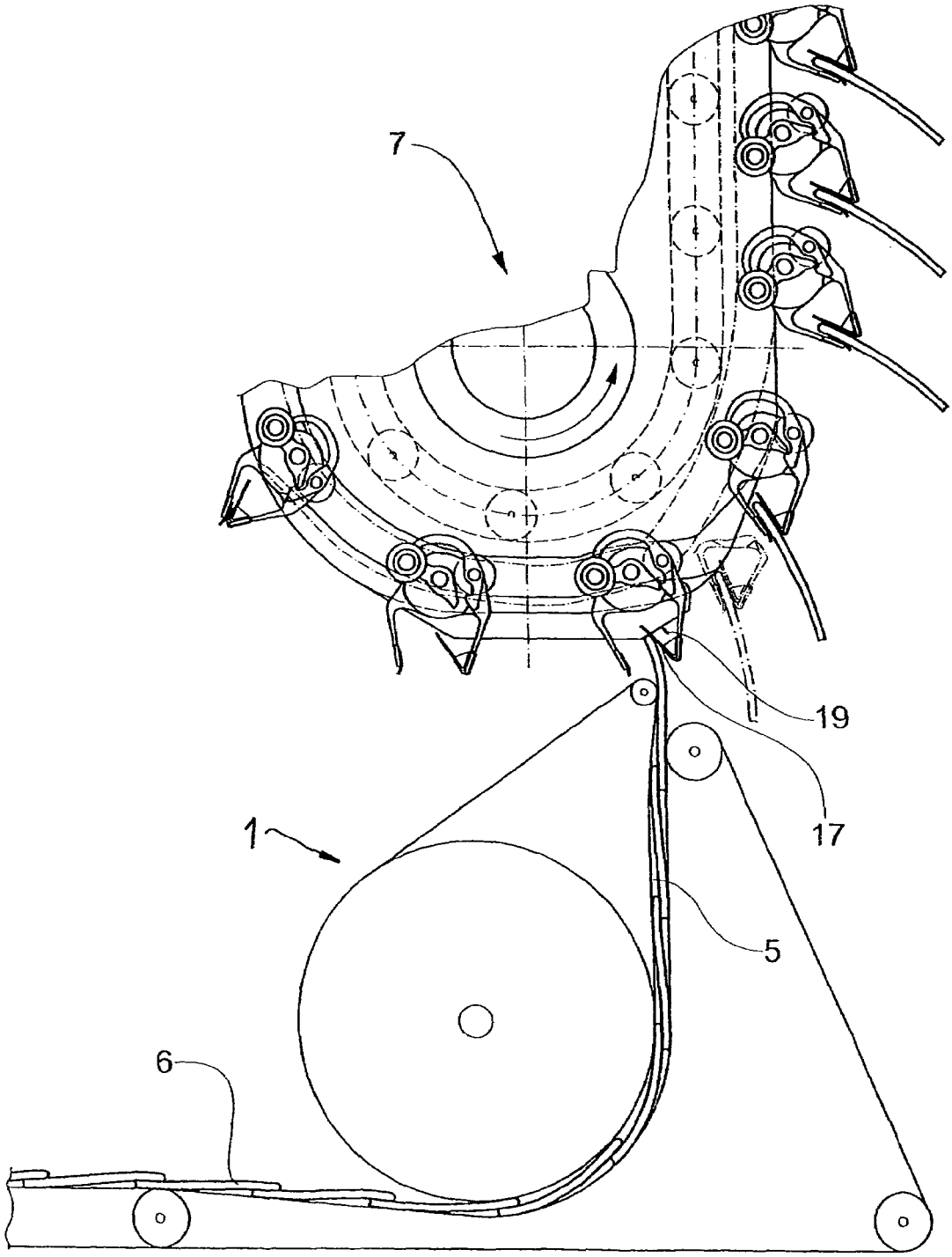
FIG. 7 shows an illustration according to FIG. 1 with product sizes which differ from FIG. 1.

FIG. 7 shows an illustration corresponding to FIG. 1, the difference being that the extent of the products 6 in the conveying direction has been reduced in relation to FIG. 1. At the same time, it is also the case according to FIG. 7 that the degree of overlap of the products 6, which are conveyed in imbricated form in the region of the feed section, is smaller than according to FIG. 1.

FIG. 7, accordingly, illustrates that the apparatus according to the invention, of which the dimensions and settings have not been changed in relation to FIG. 1, functions satisfactorily irrespective of the longitudinal extent of the products and also irrespective of the degree of overlap of the imbricated formation since it is possible to ensure, on account of the way in which the conveying nip 5 and conveying arrangement 7 are arranged according to the invention, that the products 6 are reliably conveyed against the positive stop 17, 19 irrespective of the abovementioned sizes. All that has to be ensured is that the products 6 have certain minimum dimensions in the conveying direction, these ensuring that the product is still retained in the conveying nip 5 as it strikes against the positive stop 17, 19.

FIG. 7 shows the transfer of CDs, which can take place using the same apparatus as the transfer of larger-format printed products, such as jobbing-work products, newspapers, periodicals or parts thereof, which are shown in FIGS. 1 to 6.

The apparatus can be arranged and operated in virtually all positions. This is the case in particular because the products can be conveyed with positive guidance and the spacing between the conveying nip 5 and conveying arrangement 7 can be kept minimal.

What is claimed:

1. An apparatus by means of which sheet products which follow one after the other along a feed section are transferred to a conveying arrangement with individually controllable grippers which can be moved in the conveying direction and are designed for gripping the products at their leading edge, the apparatus comprising:

said feed section having, in its end region which is directed toward the conveying arrangement, a conveying nip, in which the sheet products are retained, at least in part, on both sides, wherein, in the product-receiving region of the grippers, a positive stop, which is active during each product transfer, is provided for the leading edges of the products, the positive stop is of two-part design, a first part being of stationary configuration arranged as a stop for the leading edge of the products and a movable second part being formed by a leading leg or a guide surface, connected to said leg, of a gripper taking part in the product-transfer process and serving for guiding the leading edge of the products toward the first part, the first part and the second part forming two stop surfaces which run at an angle to one another, the spacing between the stationary first part of the positive stop and the conveying nip being selected such that the trailing edges of the products are still located in the conveying nip when the leading edges strike against the positive stop, such that the leading edge of each product abuts against the positive stop in a region of the positive stop at which the two surfaces intersect.

2. The apparatus as claimed in claim 1, wherein the guide surface, in the closed state of the gripper, is oriented at least essentially parallel to a product abutment-surface of the trailing gripper leg.

3. The apparatus as claimed in claim 2, wherein the gripper legs can be pivoted individually and/or together about a pivot pin moving in the conveying direction and are coupled, in particular, to a transporting chain or to individual carriages.

4. The apparatus as claimed in claim 2, wherein each gripper leg, in the region of the conveying arrangement, is assigned a dedicated control guide which controls the opening and closing movement of the respective gripper legs.

5. The apparatus as claimed in claim 1, wherein the feed section is designed as a conveying belt, a pressure-exerting belt which can be driven at the speed of the conveying belt and runs, at least in part, parallel to the conveying belt being provided in that end region of the conveying belt which is directed toward the conveying arrangement, for the purpose of producing the conveying nip.

6. The apparatus as claimed in claim 5, wherein the feed section, in its end region which is directed toward the conveying arrangement, runs in a plane which is inclined in relation to the horizontal.

7. The apparatus as claimed in claim 6, wherein the feed section, in its end region which is directed toward the conveying arrangement, runs in an essentially vertical plane.

8. The apparatus as claimed in claim 7, wherein the grippers, during the product-transfer, move essentially perpendicularly to the essentially vertical plane and then increasingly in the direction of the conveying nip.

9. A method of operating an apparatus as claimed in claim 1, in the case of which:

the sheet products, in that end region of the feed section which is directed toward the conveying arrangement, are transported through a conveying nip until they butt, by way of their leading edges, against the positive stop in the region at which the two surfaces of the stationary first part and the movable second part of the positive stop intersect;

the conveying movement through the conveying nip is continued and a closing movement of the grippers is initiated; and the grippers are closed completely while the trailing edges of the products are still located in the conveying nip.

10. The method as claimed in claim 9, wherein the conveying movement through the conveying nip during the closing movement of the grippers each receiving a product takes place continuously.

11. The method as claimed in claim 10, wherein the speed of the products in the conveying nip and the transporting speed of the grippers during the product-transfer process are at least essentially constant.

12. The method as claimed in claim 11, wherein the speed of the products in the conveying nip and the transporting speed of the grippers during the product-transfer process are co-ordinated with one another such that the products butting against the positive stop are buckled, or pass into a curved-out state, before the grippers are closed completely.

13. The method as claimed in claim 12, wherein the speed of the products in the conveying nip and the transporting speed of the grippers during the product-transfer process are co-ordinated with one another such that the products which are gripped by closed grippers in their front region and have their rear region still located in the conveying nip are straightened out again without the products being subjected to destructive tensile loading.

14. The method as claimed in claim 13, wherein the closing movement of the grippers is at least essentially completed while the leading edges of the products butt against the positive stop.

15. The method as claimed in claim 9, wherein a guide surface, at least over a time interval immediately preceding completion of the closing movement of the gripper legs, is oriented at least essentially parallel to the respectively trailing gripper leg.

16. The method as claimed in claim 9, wherein the products the conveying arrangements are fed in one of a regular or irregular imbricated formation or at intervals from one another.

* * * * *